United States Patent [19]

Kemp et al.

[11] Patent Number: 4,669,496

[45] Date of Patent: Jun. 2, 1987

[54] LIQUID PROPORTIONER

[75] Inventors: David M. Kemp, Naperville; Hartl R. Jones, Bensenville, both of Ill.

[73] Assignee: Figgie International Inc., Richmond, Va.

[21] Appl. No.: 898,868

[22] Filed: Aug. 20, 1986

Related U.S. Application Data

[63] Continuation of Ser. No. 825,967, Feb. 5, 1986, abandoned, which is a continuation of Ser. No. 588,427, Mar. 23, 1984, abandoned.

[51] Int. Cl.[4] ..... B67D 5/00

[52] U.S. Cl. ..... 137/209; 137/263; 137/606; 222/136

[58] Field of Search ..... 137/209, 210, 263, 606, 137/607; 222/68, 136

[56] References Cited

U.S. PATENT DOCUMENTS

| | | | |
|---|---|---|---|
| 2,028,302 | 1/1936 | Thomson | 222/68 X |
| 3,178,157 | 4/1965 | Cole | 137/99 X |
| 3,599,668 | 8/1971 | Ricardi | 137/606 X |
| 3,743,141 | 7/1973 | Mnilk | 222/136 X |
| 3,769,232 | 10/1973 | Houldridge | 252/359 E |
| 4,305,527 | 12/1981 | McMillin | 222/136 X |

FOREIGN PATENT DOCUMENTS

| | | | |
|---|---|---|---|
| 712072 | 7/1954 | United Kingdom . | |
| 763599 | 12/1956 | United Kingdom . | |
| 930377 | 7/1963 | United Kingdom | 222/136 |
| 1072647 | 6/1967 | United Kingdom . | |
| 1105753 | 3/1968 | United Kingdom . | |
| 1439197 | 6/1976 | United Kingdom . | |
| 1560753 | 2/1980 | United Kingdom . | |

*Primary Examiner*—Alan Cohan

*Attorney, Agent, or Firm*—Oldham, Oldham & Weber Co.

[57] ABSTRACT

The present application discloses a liquid mixing method and apparatus which can mix two or more liquids in selected proportions. Each constituent fluid is introduced in a chamber provided with liquid level controlling devices that establish a liquid free head space which is connected to a source of pressure gas operative to pump or displace liquid from the chamber through a metering device prior to the introduction to a chamber where the constituent fluids combine.

7 Claims, 5 Drawing Figures

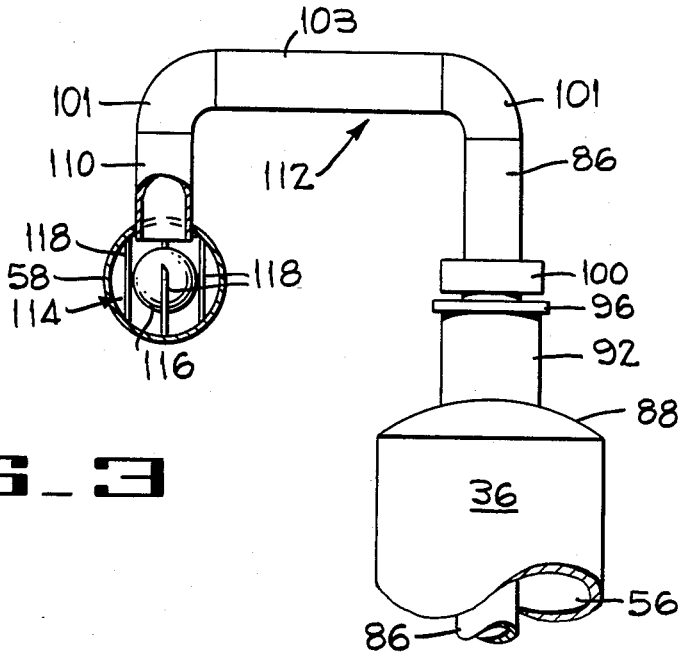
FIG_3
FIG_4
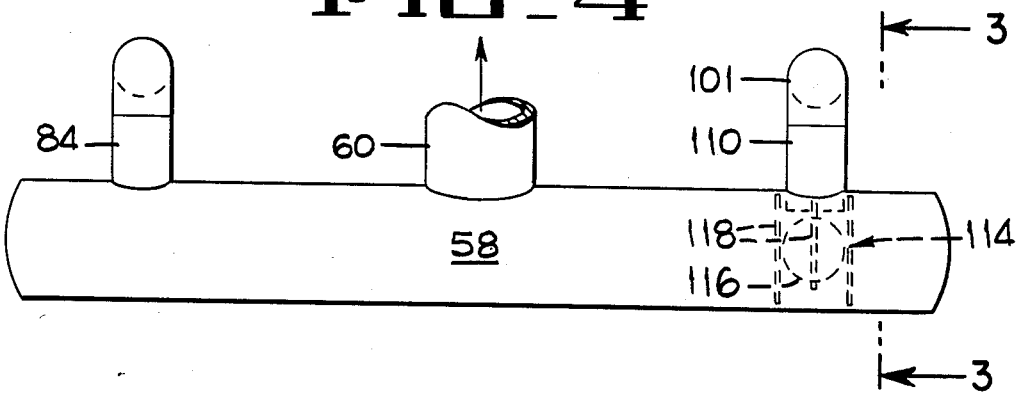
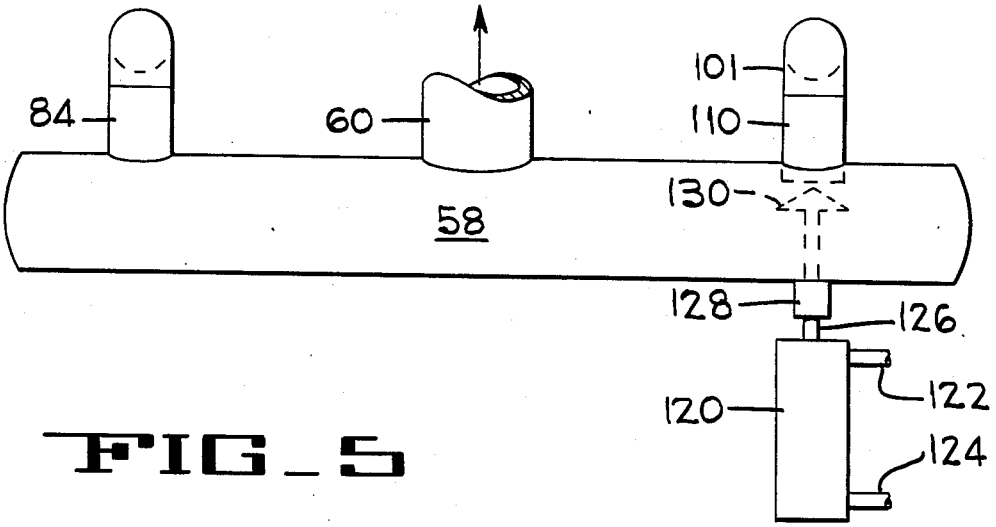
FIG_5

LIQUID PROPORTIONER

This application is a continuation of application Ser. No. 825,967 filed 2-5-86, now abandoned, which is a continuation of 588,427 filed 3-23-84, now abandoned.

BACKGROUND OF THE INVENTION

The present invention relates to equipment and processes for producing packaged beverages and more particularly equipment and processes for combining two or more constituent liquids in a desired ratio or proportion.

The liquid proportioner according to the present invention yields a variety of advantages principally resulting from the ability of the proportioner to pace or induce a constant flow rate and accordingly rather stable pressure difference between system components. Constant flow improves and maintains mix accuracy, encourages steady state operation of associated refrigerator system, and insures a sufficient quantity of blended product.

Further, and more particularly, the proportioner according to the present invention achieves a variable flow rate determined by pressure differential which in turn responds to the availability of the flow rate of constituent fluids or to the variation in flow of the combined fluids while maintaining a desired proportioning ratio.

Patented prior art relating to the type of proportioner disclosed herein include the U.S. Pat. Nos. to WITT et al 3,237,808 issued Mar. 1, 1969, and Mnikl et al 3,743,141 issued July 3, 1973. The WITT et al patent is assigned to the assignee of the present application and by reference thereto it is intended that its disclosure be incorporated herein.

BRIEF DESCRIPTION OF THE DRAWINGS

FIG. 3 is a fragment of a chamber containing a constituent fluid and is a section, taken along the line 3—3 of FIG. 4.

FIG. 4 illustrates a chamber for receiving the constituent fluids and a pressure response valve in one conduit supplying fluid to the chamber, and FIG. 5 is similar to FIG. 4 but the valving element is operated by a linear actuator.

DESCRIPTION OF THE PREFERRED EMBODIMENT

Figure 1:
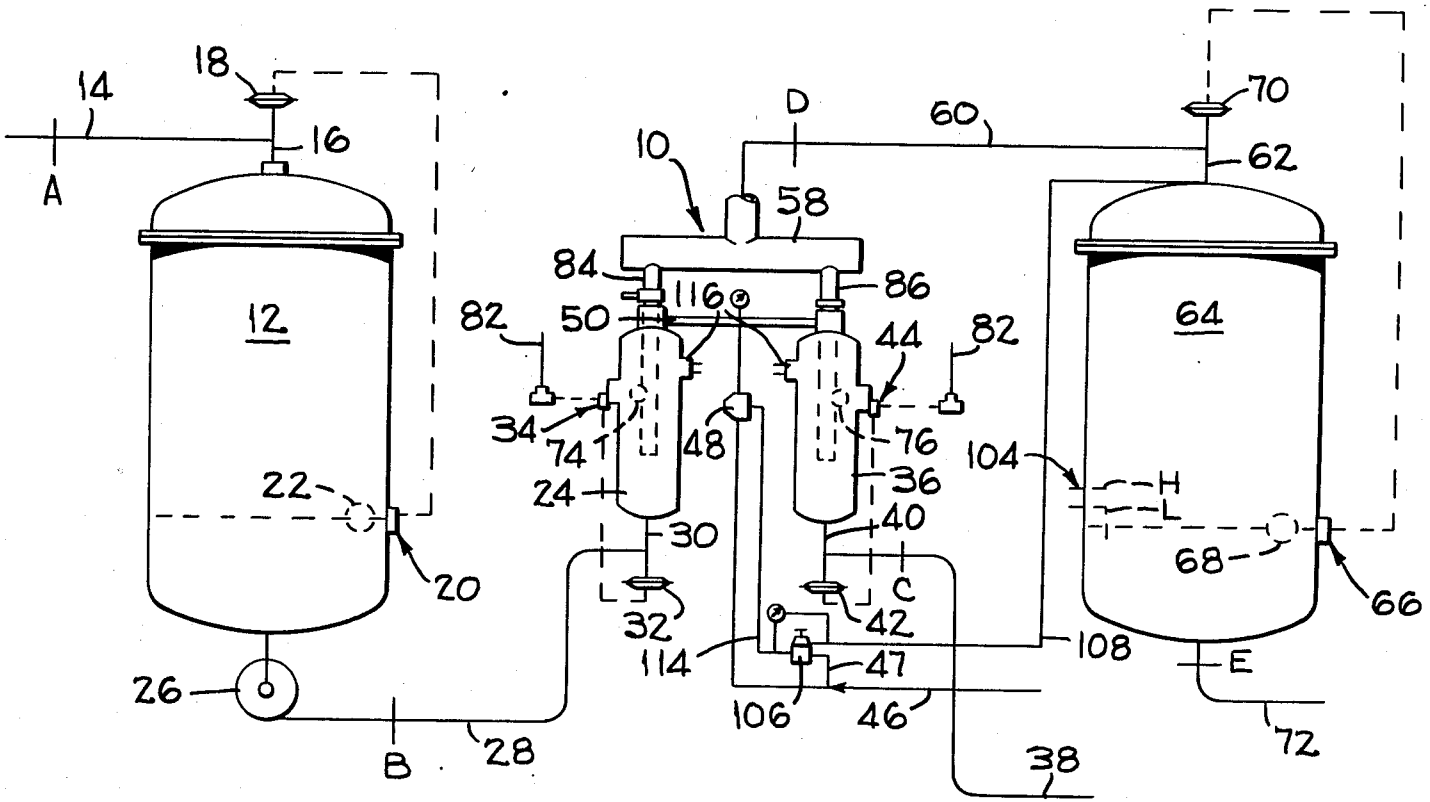
FIG. 1 shows the proportioner according to the present invention connected to a cooler and carbonating-cooler vessel.

The beverage mixing unit or proportioner constructed in accordance with the principle of the present invention is generally identified by the numberal 10. While more than two fluids can combined in any selected ratio, the operation of the disclosed proportioner will be described by making reference to two fluids, water and beverage syrup or concentrate.

Water conditioned for use as a beverage is introduced in a pre-cooler and/or deaerator tank 12 and by a conduit 14 which is connected to a conduit 16. A diaphragm valve 18 operated by a conventional level sensor 20, including a float 22, controls the level of water in tank 12. Water from the tank 12 is pumped to a chamber 24 by a pump 26 through a conduit 28 which is connected to a conduit 30. The quantity of water in the chamber 24 is maintained substantially constant by a diaphragm valve 32 operated by a level sensor 34 including a float 74.

In like manner, beverage concentrate or syrup from a suitable source is directed to a chamber 36 by conduits 38 and 40 and the level of syrup is maintained substantially constant by a diaphragm valve 42 operated by a level sensor 44 including a float 76.

Each of the chambers 24 and 36 are connected to a source of inert gas, such as carbon dioxide or nitrogen, by a line 46 (FIG. 2) supplying the selected gas at approximately 300 pounds per square inch to a pressure reducing and control valve 48 which in turn has its low pressure output connected to a manifold or balancing line 50 by a line 52. Pressurized inert gas admitted to the chambers 24 and 36 establishes liquid free head spaces 54 and 56 of variable volume but at constant pressure. As will be explained in greater detail hereinafter, the constant pressure gas in each head space displaces the water and beverage concentrate to a mixing chamber or tank 58 at a rate at which the combined liquids are withdrawn by a filler (not shown). As shown in FIG. 1, the combined liquid is displaced or pumped from the tank 58 by lines 60 and 62, to a carbonator-cooling tank 64 which may be provided with a level control 66, including a float 68, operating a diaphragm valve 70 that controls the rate at which the mixed liquids are introduced into the tank 64. The mixed, cooled and carbonated liquid is connected to a filler (not shown) by a line 72.

The proportioner according to the present invention responds to changes in the flow rate of the individual liquids or the combined liquids by the fact that the pressure differential automatically changes in response to flow rate changes. Changes in pressure differential promptly changes or adjusts flow rates. While the mix ratio is maintained constant, the principal benefit of automatic pressure differential adjustment establishes substantially constant levels of flow rate that diminishes or obviates cycling of the refrigeration system resulting from a mismatch of proportioner capacity to filler capacity.

Figure 2:
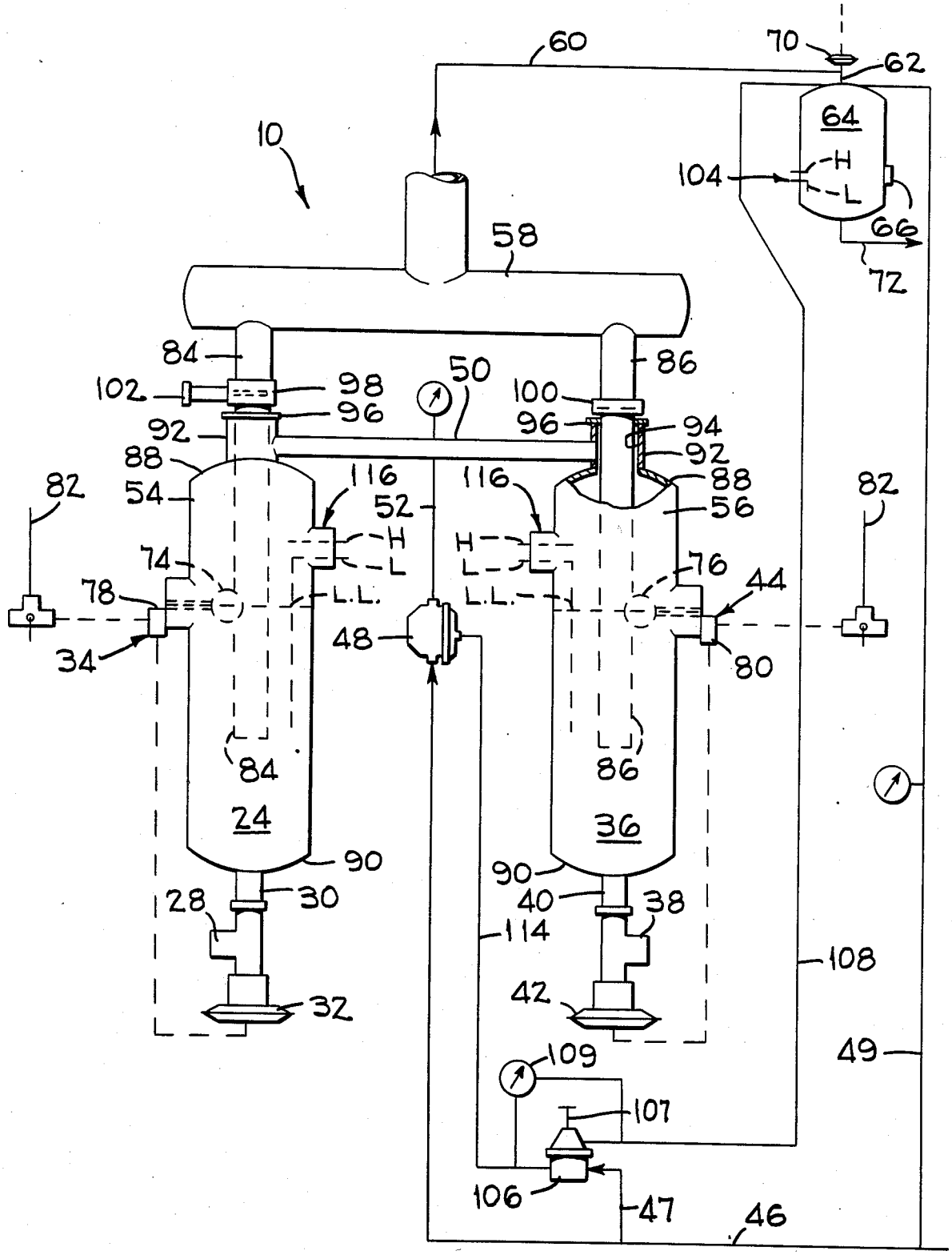
FIG. 2 is an enlarged view of the proportioner.

With reference to FIG. 2, showing an enlarged representation of the proportioner 10, it will be observed that in each chamber 24 and 36 a nominal liquid level L.L. is established by liquid level sensors 34 and 44, associated, respectively with the floats 74 and 76 actuating, in response to the liquid level, mechanical valves 78 and 80. On decline of the liquid level and consequent lowering of one or both floats, the associated valve 78 and/or 80 is actuated to direct pressure supplied by shop air lines 82 to diaphragm valves 32 and/or 42 increasing the rate of water/beverage syrup to chamber 24 and/or 36 until the nominal liquid level L.L. is reestablished.

The mixing chamber 58 communicates with water containing chamber 24 by a conduit 84 and with the syrup containing chamber 36 by a conduit 86. Each conduit 84 and 86 extends into the body of liquid of each chamber and terminates substantially below the nominal liquid level L.L. The operating level of chambers 24 and 36 is held constant at all times during normal operation.

The chambers 24 and 36 are preferably elongated cylindrical shells closed at each end by upper and lower convex walls 88 and 90, respectively. The upper walls 88 are bored and integrally joined to upwardly extending nipple 92 that is of greater internal diameter than the diameter of conduits 84 and 86 to define an annular passageway 94 (only one of which is illustrated) forming an extension of the head spaces 54 and 56. The ends of the line 50, supplied with carbon dioxide gas, are connected to the nipples 92 and thus permit the introduction of carbon dioxide to the head spaces 54 and 56. A suitable seal or packing gland 96 is provided on the upper end of each nipple to insure containment of the carbon dioxide gas in the head spaces 54 and 56.

According to the arrangement thus far described, pumping of the constituent liquids, water and syrup, from the chambers 24 and 36 to the mixing chamber 58 is achieved by maintaining a greater gas pressure in head spaces 54 and 56 than the pressure of chamber 58 while concurrent replenishment of the constituent liquids occur at substantially the same rate of withdrawal.

To achieve a selected ratio of the constituent liquids in the mixing tank 58, orifices 98 and 100 are provided in conduits 84 and 86, respectively. Orifice 100 has a fixed cross-sectional flow area selected to fulfill production requirements while orifice 98 is provided with micrometer screw adjustment 102 for adjusting the flow area and thus establish the desired ratio of the two liquids. It is preferable to place the adjustable orifice 102 in the stream which will have the higher flow rate. While the ratio of the constituent fluids introduced in mixing chamber 58 is determined by the flow area of orifice 98, as set by the adjustment of micrometer screw 102, and its relation to the flow area of orifice 100, the rate at which the liquids flow from chamber 24 and 36 to the mixing chamber 58 is established by the pressure difference between the chambers and the tank. However the flow rate from the chamber 58 to the tank 64 is regulated by the diaphragm valve 70.

Carbon dioxide ($CO_2$) is supplied to the proportioner 10 and to the carbonator-cooling tank 64 by the supply line 46 having a branch line 47 connected to a bias regulator valve 106, supplying $CO_2$ at a selected pressure to the signal port of pressure reducing and control valve 48, and a branch line 49 serving to supply $CO_2$ to a pressure reducing and control valve (not shown) which in turn supplies a pressure regulated supply of gas to tank 64. For purposes of this disclosure the pressure supplied to the tank is approximately 50 pounds per square inch gauge.

To establish a nominal flow rate of the blended liquids from the mixing chamber 58 to the carbonating-cooler tank 64 the bias regulator valve 106 is adjusted, by hand operated screw 107, until the reading of a pressure differential gauge 109 indicates a level of pressure greater than the pressure in line 108 whose pressure is equal to the actual pressure within tank 64, that is 50 psig. $CO_2$ at supply pressure is introduced to the bias regulator valve 106 by the branch line 47. The output pressure in a line 114, connecting valve 106 with the pressure reducing valve 48, is equal to the pressure in line 108 plus a bias pressure displayed by the gauge 109. For example, one level of bias pressure may be 5 psig. yielding a total pressure of 55 psig. in line 114. The differential pressure of 5 psig. will be maintained across the valve 106 regardless of any increases or decreases in the pressure line 108. The set pressure differential constitutes the pressure difference between the head spaces 54 and 56 and the tank 64 and such a differential will be calculated taking into consideration the proportion of the individual liquids, for example viscosity, and the desired flow rate through the orifices 98 and 100. Accordingly, based on the exemplary pressure mentioned above, the pressure of $CO_2$ in the head spaces 54 and 56 will under all operating conditions be 5 psig. greater than the pressure in the carbonator-cooler tank 64.

Each of chambers 24 and 36 is provided with high-low level probes 116 each of which have a high level probe H and a low level probe L. The probes operate in a range of fluid levels beyond the range controlled by the floats 74 and 76. In the event flow of water or syrup is greater, diminished or interrupted to an anticipated degree viz., changing of syrup tanks or failure of sufficient water supply, the high level probes H will, in the instance of too much liquid in one or both of the chamber 24 and 36, detect liquid immersion and promptly close valve 32 or 42, respectively, depending on which chamber has excess liquid. Should the liquid level fall below the end of the low level probes L valve 70 will be promptly closed to stop all forward flow.

Using the float level control 66 or the high-low level probes 104 in carbonator-cooling tank 64 has no effect on the flow of mixed liquids from the mixing chamber 58 to the tank 64 since both types of controls operate diaphragm valve 70 to modulate flow to the tank 64. The combined flow rate to tank 64 is constant and is manually adjustable by changing the setting of the bias relay valve 106, which, in turn, causes regulator valve 48 to adjust the gas pressure in the head spaces 54 and 56. Should the level in the tank 64 reach the high probe H then valve 70 will close causing the flow of combined fluids from chamber 58 to stop. The pressure in line 60 and the chamber 58 will increase and be equal to the pressure in the head spaces 54 and 56 establishing a zero pressure drop across the orifices 98 and 100. In a similar fashion when the fluid level in tank 64 increases the float 68 (FIG. 1) actuates air controls 66 causing valve 70 to reduce the flow rate of fluid through the conduit 62. Flow rate reduction causes an increase of pressure in the line 60 and the chamber 58 thus reducing the pressure differential across the orifices 98 and 100 and accordingly the flow rate of the constituent fluid proportionally and the flow rate of the combined fluids.

$CO_2$ is supplied through line 46, (FIG. 2) to regulator valve 48 where it is reduced to a set pressure determined by bias relay valve 106. This regulated pressure is supplied through line 52, to line 50 and to the head spaces 54 and 56. Conduit 50 is of sufficient size to maintain equal pressures between head spaces 54 and 56. Pressure in the head spaces 54 and 56 force the liquid in each of the chambers 24 and 36 up the conduits 84 and 86 to the mixing chamber 58. The quantity or flow rate of the water and syrup is determined by the pressure differential between head spaces 54 and 56 and mix chamber 58 and also by the size of orifices 98 and 100 the water and syrup produce a blended liquid having a fixed proportion of each constituent liquid. The carbonator-cooler tank 64 is connected by a line 49 to a source of $CO_2$ provided at a rate and pressures which will insure proper carbonation of the blended liquids. The float 68 and its associated valve 70 control the rate at which the blended liquids are admitted to the tank 64 with such rate responding directly to the rate at which the carbonated, cooled and blended liquids are conveyed by the line 72 to a container filling apparatus (not shown).

The described proportioner and the disclosed environment in which it functions to achieve substantially constant liquid flow through a system, results in steady state operation of the refrigeration system, consistently accurate proportioning of the constituent fluids prompt proportioner response to meet container filler demands and a consistent carbonation level.

To further illustrate operation of the proportioner in the disclosed system the following examples of flow rate, temperature and pressure are given with reference to selected lines and conduits of the system which are identified as A in conduit 14, B in conduit 28, C in conduit 38, D in line 60 and E in conduit 72. The notation Q, T and P represent gallons per hour, temperature in degrees fahrenheit and pounds per square inch gauge, respectively.

EXAMPLE 1

A. Q=6000, P=50, T=70
B. Q=6000, P=70, T=45
C. Q=1500, P=70, T=70
D. Q=7500, P=45, T=52
E. Q=7500, P=40, T=36

EXAMPLE 2

A. Q=4166, P=50, T=70
B. Q=4166, P=70, T=45
C. Q=834, P=70, T=70
D. Q=5000, P=45, T=52
E. Q=5000, P=40, T=36

While the fluid proportioning and mixing apparatus and its mode of operation described above fulfills the objective of continuous accurate proportioning of fluids during steady state operations, shut down or a momentary interruption of flow, such as correcting problems with the container filling apparatus, can establish conditions whereby one or both individual fluids or mixed fluids flow in directions causing intermixing during the transient period of pressure equalization. The potential for intermixing may be detected where fluids of different specific gravity are being combined.

In accordance with the present invention means, illustrated in FIGS. 3, 4 and 5 are provided for maintaining the separation of fluids during the creation of transient conditions arising when normal flow of fluids is interrupted. More particularly, during the change from normal flow to no flow the established pressure differential of approximately 5 psig. declines to zero and during this transition achieving equilibrium includes, among other factors, the dissipation of flow energy which is related to the specific gravity of the fluids being mixed.

FIG. 3 shows a fragment of the upper portion of the chamber 36 containing syrup or concentrate. The conduit 86 communicates with the mixing chamber 58 by elbows 101 joined to a straight section of conduit 103 and to the mixing chamber 58 by a short nipple 110 opening into the mixing chamber 58. By locating the mixing chamber 58 relative to the chamber 36 as shown in FIG. 3 a trap 112 is defined to increase the resistance of flow and mitigate the tendency of uncontrolled intermixing of the fluid having a higher specific gravity with the fluid or fluids of lower specific gravity. In addition to the trap 112 the chamber is provided with a fluid flow direction responsive check valve 114 which essentially comprises a bouyant ball 116 constrained by wires or rods 118 to plug and seal the nipple 110 in the event the direction of flow is from the chamber 58 to the chamber 36. The valve 114 thus promptly prevents flow of mixed fluids to flow to the chamber 36 and accordingly dilution of the heavier gravity fluid is prevented.

Where preference or conditions indicate resort to a power actuated valve, one arrangement which can be used is shown in FIG. 5.

A linear actuator 120, connected to a source of pressure fluid by lines 122 and 124, has its output rod 126 passing through a bulkhead fitting 128 provided with an appropriate conventional seal. The end of the rod 126 carries a shallow conical plug 130 which, when seated in the opening of nipple 110 isolates the mixing chamber 58 from the nipple 110 and the chamber 36 communicating therewith.

In the absence of a valving element, such as 116 or 130, the fluid of greater specific gravity will reverse flow direction, from the mixing chamber 58 to the chamber 36, and in the course thereof induce flow of the mixed liquids into the chamber 36 when the system is not in forward flow. Transient detrimental flow continues until equalibrium is achieved. Where flow interruptions are infrequent detection of an improper mix in the carbonator-cooler by conventional monitoring devices is questionable but frequent flow interruptions are detected and may be evident to the consumer.

Although the best mode contemplated for carrying out the present invention has been herein shown and described, it will be apparent that modification and variation may be made without departing from what is regarded to be the subject.

What is claimed is:

1. A proportioning apparatus for combining at least two liquids in a determined proportion comprising:
- a receiving chamber for each liquid;
- a mixing chamber connected to said receiving chambers;
- an orifice interposed between each of said receiving chambers and said mixing chamber;
- tank means connected to said mixing chamber;
- first means for introducing gas under pressure to said tank means;
- second means for introducing gas to said receiving chambers to pressurize the same at equal pressure; and
- pressure adjusting means responsive to pressure changes in said tank means to alte the pressure in said receiving chambers to maintain a constant pressure differential between said tank means and said receiving chambers.

2. The apparatus according to claim 1, and further comprising:
- means for selectively setting the pressure differential to be maintained by said pressure adjusting means.

3. The apparatus according to claim 1, and further comprising:
- level sensing means for determining the level of liquid within said tank means; and
- modulating valve means interposed betwen said mixing chamber and said tank means responsive to said level sensing means to reduce the flow from said mixing chamber as the level of liquid rises above a predetermined level.

4. A beverage proportioning apparatus for combining at least two liquids in a selected proportion and intended for use with an unlimited source of gas pressure; said apparatus comprising:
- a receiving chamber for each liquid;
- a mixing chamber connected to said receiving chambers;
- an orifice interposed between each of said receiving chamber and said mixing chamber;

receptacle means connected to said mixing chamber; and adjustable gas pressure regulating valve means connected to said source and to said receiving chambers for reducing said source pressure to a selected pressure and applying said selected pressure equally to said receiving chambers and to maintain a constant pressure differential between said receiving chambers and said receptacle means.

5. The invention according to claim 4, and further comprising:

a modulating valve downstream of said mixing chamber;

level sensing means in one of said receiving chambers; and means responsive to said level sensing means to close said modulating valve to reduce the flow from said mixing chamber when said level sensing means indicates the fluid level in said one receiving chamber has fallen below a predetermined minimum.

6. A proportioning apparatus for combining a plurality of liquids, mixing said liquids in a determined proportion and depositing said mixed liquids in a vessel at a controlled rate of flow comprising:

a plurality of discrete chambers for receiving the individual liquids to be mixed;

means for introducing said liquids into said discrete chambers;

a mixing chamber;

means connecting each said discrete chamber to said mixing chamber whereby liquid may pass from said discrete chambers to said mixing chamber;

means to receive said mixed liquids from said mixing chamber;

means connecting said mixing chamber and said receiving means; and means for applying substantially equivalent positive fluid pressure to said liquid in each of said discrete chambers and for maintaining a controlled pressure differential between said discrete chambers and said receiving means whereby said liquids are forced under pressure from said discrete chambers, into and through said mixing chamber and into said receiving means at controlled rates of flow.

7. A proportioning apparatus according to claim 6 having means associated with said means connecting each said discrete chamber to said mixing chamber for controlling the rate of flow of liquid from said discrete chamber to said mixing chamber as a result of said pressure differential between each said discrete chamber and said receiving means whereby to introduce into said mixing chamber a predetermined ratio of said individual liquids.

* * * * *